US007583169B1

(12) United States Patent
Scardelletti

(10) Patent No.: US 7,583,169 B1
(45) Date of Patent: Sep. 1, 2009

(54) MEMS SWITCHES HAVING NON-METALLIC CROSSBEAMS

(75) Inventor: Maximillian C Scardelletti, Brunswick, OH (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 246 days.

(21) Appl. No.: 11/689,770

(22) Filed: Mar. 22, 2007

(51) Int. Cl.
*H01P 1/10* (2006.01)
*H01P 5/00* (2006.01)

(52) U.S. Cl. ..... 333/262; 333/105

(58) Field of Classification Search ..... 333/262, 333/101, 105; 200/181
See application file for complete search history.

(56) References Cited

U.S. PATENT DOCUMENTS

| | | | | |
|---|---|---|---|---|
| 5,258,591 | A | 11/1993 | Buck | |
| 5,367,136 | A | 11/1994 | Buck | |
| 5,578,976 | A | 11/1996 | Yao | |
| 5,619,061 | A | 4/1997 | Goldsmith et al. | |
| 6,621,387 | B1 | 9/2003 | Hopcroft | |
| 6,633,212 | B1 | 10/2003 | Ruan | |
| 6,646,215 | B1 | 11/2003 | Nelson | |
| 6,713,695 | B2 * | 3/2004 | Kawai et al. | 200/181 |
| 6,714,105 | B2 | 3/2004 | Eliacin et al. | |
| 6,812,814 | B2 * | 11/2004 | Ma et al. | 333/262 |
| 6,815,866 | B2 | 11/2004 | Lee | |
| 6,850,133 | B2 | 2/2005 | Ma | |
| 6,875,936 | B1 | 4/2005 | Suzuki et al. | |
| 6,960,971 | B2 | 11/2005 | Park et al. | |
| 2004/0085166 | A1 | 5/2004 | Kang et al. | |
| 2004/0222074 | A1 | 11/2004 | Bouche et al. | |

OTHER PUBLICATIONS

Scardelletti, et al., Ka-Band MEMS Switched Line Phase Shifters Implemented in Finite Ground Coplanar Waveguide, 32nd Ueopean Microwave Conference Dig., pp. 797-800, Milan, Italy, Sep. 23-27, 2002.

Scardelletti et al., MEMS, Ka-Band Single Pole Double-Throw (SPDT) Switch for Switched Line Phase Shifters, 0-7803-7330-8/02 Copyright 2002 IEEE.

* cited by examiner

*Primary Examiner*—Dean O Takaoka
(74) *Attorney, Agent, or Firm*—Mark Homer

(57) ABSTRACT

A RF MEMS switch comprising a crossbeam of SiC, supported by at least one leg above a substrate and above a plurality of transmission lines forming a CPW. Bias is provided by at least one layer of metal disposed on a top surface of the SiC crossbeam, such as a layer of chromium followed by a layer of gold, and extending beyond the switch to a biasing pad on the substrate. The switch utilizes stress and conductivity-controlled non-metallic thin cantilevers or bridges, thereby improving the RF characteristics and operational reliability of the switch. The switch can be fabricated with conventional silicon integrated circuit (IC) processing techniques. The design of the switch is very versatile and can be implemented in many transmission line mediums.

20 Claims, 6 Drawing Sheets

(spin-on photoresist)

(pattern resist)

(deposit metal)

(liftoff resist)

(deposit SiO2 sacrificial layer)

(define posts for bridge)

(pattern resist)

(etch post holes, remove resist)

(deposit SiC, PECVD)

(Ion Implantation)

(anneal)

(photoresist, pattern bridge)

(etch, remove resist)

(resist, pattern for bridge metal)

(bridge metal)

(remove resist and excess metal)

(remove sacrificial SiO2)

(illustrating a cantilever crossbeam)

(showing deflection of the crossbeam)

MEMS SWITCHES HAVING NON-METALLIC CROSSBEAMS

STATEMENT REGARDING FEDERALLY SPONSORED RESEARCH OR DEVELOPMENT

The invention described herein was made by an employee of the United States Government and may be manufactured and used by or for the Government for Government purposes without the payment of any royalties thereon or therefore.

TECHNICAL FIELD

The invention relates to microelectromechanical system (MEMS) switches and, more particularly, to MEMS switches for radio frequency (RF) and microwave applications.

BACKGROUND

Currently in RF applications there are two types of switches that can be used to perform switching functions. The most popular and commercially available is the semiconductor device. This includes such devices as PIN diodes, field effect transistors (FETs) and heterojunction bipolar transistors (HBTs). They can be very lossy, expensive to fabricate, and complicate integration with other ICs. The other switch, more recently developed and commercially available to a limited extent, is the RF MEMS switch.

Typical RF MEMS switches are developed with standard IC processing which make fabrication and integration low cost and simple. However typical RF MEMS switches have cantilevers/bridges constructed from a single metal layer or a combination of metal layers.

A microelectromechanical system (MEMS) is a microdevice that integrates mechanical and electrical elements on a common substrate using microfabrication technology. The electrical elements are formed using known integrated circuit fabrication techniques, while the mechanical elements are fabricated using lithographic techniques that selectively micromachine portions of a substrate. Additional layers are often added to the substrate and then micromachined until the MEMS device is in a desired configuration. MEMS devices include actuators, sensors, switches, accelerometers, and modulators.

MEMS switches have intrinsic advantages over conventional solid-state counterparts such as field-effect transistor switches. The advantages include low insertion loss and excellent isolation. However, MEMS switches are generally much slower than solid-state switches. This speed limitation precludes applying MEMS switches in certain technologies, such as wireless communications, where sub-microsecond switching is required.

One type of MEMS switch includes a suspended connecting member, or beam, that is electrostatically deflected by energizing an actuation electrode. The deflected beam engages one or more electrical contacts to establish an electrical connection between isolated contacts. A beam anchored at one end while suspended over a contact at the other end is called a cantilevered beam. A beam anchored at opposite ends and suspended over one or more electrical contacts is called a bridge beam.

There are two types of MEMS switches: metal-to-metal contact and capacitive. Metal-to-metal contact switches consist of a metal transmission line and a metal bridge/cantilever that are separated by an air gap. This type of switch requires a DC voltage to actuate but suffers from the metal contacts wearing down and welding after prolonged use, thus causing the switch to fail. The other type, capacitive MEMS switches, employ a thin insulator and air gap between the transmission line and the bridge/cantilever to prevent the two metal structures from touching in an effort to prevent the metal connects from welding together. This type of switch requires a low voltage peak-to-peak sine wave voltage to actuate. The low frequency peak-to-peak voltage waveform is needed to prevent charge trapping within the insulator film and seriously degrades the performance of the switch and complicates the biasing structure of the overall system.

However, the greatest disadvantage of the two types (contact and capacitive) of MEMS switches is that they utilize metal bridge/cantilever structures that are very unreliable due to severe sagging and eventual failure during prolonged operations. This drastically reduces the reliability of the switches. Reliability is the single most important issue now prohibiting metal-based RF MEMS switches from being implemented in a wide range of commercial applications, as well as applications for military and space.

RELATED PATENTS AND PUBLICATIONS

The following patents and publications are incorporated by reference in their entirety herein.

US Patent Publication No. 2004/0085166 discloses a radio frequency device using a micro-electronic-mechanical system (MEMS) technology that can be applied to a mobile communication area by reducing the operating voltage, while increasing the operating speed. The RF device includes: a substrate; a first electrode which is mounted on the substrate and forms an actuator, part of the first electrode not contacting the substrate; and a second electrode which is apart in a regular space from the substrate and forms an actuator, part of the second electrode being overlapped with the first electrode, wherein the first electrode and the second electrode contact each other at a contact point by an electrostatic attractive force generated between the two electrodes. In this publication, the top and bottom electrodes are formed of metal.

US Patent Publication No. 2004/0222074 discloses a lateral displacement multiposition microswitch. A multiposition microswitch that includes a cavity, a mobile portion made of a deformable material extending above the cavity, at least three conductive tracks extending on the cavity bottom, and a contact pad on the lower surface of the mobile part. The mobile part is capable of deforming, under the action of a stressing mechanism, from an idle position where the contact pad is distant from the conductive tracks to an on position from among several distinct on positions. The contact pad electrically connects, in each distinct on position, at least two of the at least three conductive tracks, at least one of the conductive tracks connected to the contact pad in each distinct on position being different from the conductive tracks connected to the contact pad in the other distinct on positions. In this publication current applied to cause the bridge to deform downwards towards the bottom electrode.

U.S. Pat. No. 5,258,591 discloses a low inductance cantilever switch. An apparatus is disclosed for providing an electrostatically actuated mechanical switch utilizing a cantilever beam element fabricated by solid-state microfabrication techniques. The apparatus reduces the required pull down voltage and lowers the switch inductance by separating the pull down electrode and contact pad. The pull down electrode is placed further away from the fulcrum of the cantilever beam then the contact pad to optimize the mechanical advantages which allow for a reduced pull down voltage. The contact pad is placed closer to the cantilever fulcrum to reduce the associated switch inductance. The gap between the contact pad and the cantilever beam is less then the gap between the pull down electrode and the cantilever beam to insure that the cantilever makes first contact with the contact pad.

U.S. Pat. No. 5,367,136 discloses a non-contact two position microelectronic cantilever switch. A microelectrostatic cantilever switch that has a thin impermeable oxide layer on the surface of a contact pad which is engaged by an unsupported portion of a cantilever beam when the switch is in a closed position. The switch in the open position exhibits a capacitance between the cantilever beam and contact pad of 0.8 Pf and a capacitance of 0.001 to 0.01 Pf in the closed position.

U.S. Pat. No. 5,578,976 discloses a micro electromechanical RF switch. A micro electromechanical RF switch is fabricated on a substrate using a suspended microbeam as a cantilevered actuator arm. From an anchor structure, the cantilever arm extends over a ground line and a gapped signal line that comprise microstrips on the substrate. A metal contact formed on the bottom of the cantilever arm remote from the anchor is positioned facing the signal line gap. An electrode atop the cantilever arm forms a capacitor structure above the ground line. The capacitor structure may include a grid of holes extending through the top electrode and cantilever arm to reduce structural mass and the squeeze damping effect during switch actuation. The switch is actuated by application of a voltage on the top electrode, which causes electrostatic forces to attract the capacitor structure toward the ground line so that the metal contact closes the gap in the signal line. The switch functions from DC to at least 4 GHz with an electrical isolation of −50 dB and an insertion loss of 0.1 dB at 4 GHz. A low temperature fabrication process allows the switch to be monolithically integrated with microwave and millimeter wave integrated circuits (MMICs). The RF switch has applications in telecommunications, including signal routing for microwave and millimeter wave IC designs, MEMS impedance matching networks, and band-switched tunable filters for frequency-agile communications.

U.S. Pat. No. 5,619,061 discloses micromechanical microwave switching. Micromechanical microwave switches with both ohmic and capacitive coupling of rf lines and integration in multiple throw switches useful in microwave arrays.

U.S. Pat. No. 6,621,387 discloses a micro-electro-mechanical systems switch. A micro-electro-mechanical switch includes a transmission line having a gap disposed along it. The switch also includes at least one ground plane located proximal to the transmission line. A first bridge is configured to close the gap along the transmission line, and a second bridge is configured to connect the transmission line to the ground plane. A method of manufacturing a micro-electromechanical switch includes forming, on a first substrate, a transmission line and at least one ground plane, wherein the transmission line includes a gap along it. The method also includes forming, on a second substrate, a first bridge configured to close the gap disposed along the transmission line, and a second bridge configured to connect the transmission line to the ground plane. Then transferring the first and second bridges to the first substrate.

U.S. Pat. No. 6,633,212 discloses electronically latching micro-magnetic switches and method of operating same. A switch with an open state and a closed state suitably includes a cantilever having first and second state corresponding to the open and closed states of the switch, respectively. The switch may also include a magnet configured to provide an electromagnetic field that maintains said cantilever in one of the first and second states. Various embodiments may also include an electrode or electrical conductor configured to provide an electric potential or electromagnetic pulse, as appropriate, to switch the cantilever between the first and second states. Various embodiments may be formulated with micromachining technologies, and may be formed on a substrate.

U.S. Pat. No. 6,646,215 discloses a device adapted to pull a cantilever away from a contact structure. A device is provided which is adapted to electrostatically pull a cantilever away from a conductive pad. In particular, a microelectromechanical device is provided which includes a fulcrum contact structure interposed between two electrodes spaced under a cantilever and a conductive pad arranged laterally adjacent to one of the electrodes. The cantilever may be brought into contact with the conductive pad by residual forces within the cantilever and/or an application of a closing voltage to one of the electrodes. Such a device may be adapted bring the cantilever in contact with the fulcrum contact structure by applying an actuation voltage to the other of the electrodes. In addition, the actuation voltage may deflect the cantilever away from the conductive pad. In some cases, deflecting the cantilever from the conductive pad may include releasing the closing voltage and increasing the actuation voltage subsequent to the release of the closing voltage. The cantilever may include a variety of materials including a dielectric and/or a conductive material.

U.S. Pat. No. 6,714,105 discloses a micro electromechanical system method. A meso-scale MEMS device having a cantilevered beam is formed using standard printed wiring board and high density interconnect technologies and practices. The beam includes at least some polymer material to constitute its length, and in some embodiments also comprises a conductive material as a load bearing component thereof. In varying embodiments, the beam is attached at a location proximal to an end thereof, or distal to an end thereof.

U.S. Pat. No. 6,815,866 discloses a metal cantilever having step-up structure and method for manufacturing the same. A cantilever having a step-up structure and a method of manufacturing the same. The cantilever includes a substrate, an anchor formed on the substrate, and a moving plate connected to the anchor while maintaining a predetermined gap from the substrate. The anchor includes a first anchor of a predetermined shape and a second anchor perpendicular to an edge of the first anchor while being formed along a longitudinal axis of the moving plate. Accordingly, a deformation of the cantilever caused by the high temperature and pressure in a manufacturing process thereof is considerably reduced. As a result, the yield rate of the cantilever is improved, and the reliability of a product using the cantilever is also improved.

U.S. Pat. No. 6,850,133 discloses an electrode configuration in a MEMS switch. A microelectromechanical system (MEMS) switch that includes a signal contact, an actuation electrode and a beam that engages the signal contact when a voltage is applied to the actuation electrode. The signal contact includes a first portion and a second portion. The actuation electrode is positioned between the first and second portions of the signal contact.

U.S. Pat. No. 6,875,936 discloses a micromachine switch and its production method. A micro-machine switch includes a supporter having a predetermined height relative to a surface of a substrate, a flexible cantilever projecting from the supporter in parallel with a surface of the substrate, and having a distal end facing a gap formed between two signal lines, a contact electrode formed on the cantilever, facing the gap, a lower electrode formed on the substrate in facing relation with a part of the cantilever, and an intermediate electrode formed on the cantilever in facing relation with the lower electrode. The micro-machine switch can operate at a lower drive voltage than a voltage at which a conventional micromachine switch operates, and can enhance a resistance of an insulating film against a voltage.

U.S. Pat. No. 6,960,971 discloses a microelectro mechanical system (MEMS) switch. The MEMS switch includes a substrate; a signal line formed on the substrate; a beam deformed by an electrostatic force to electrically switch with the signal line; and a spring type contact unit formed on the signal line to electrically contact the beam and elastically deformed by an external force. Thus, stability of the contact between the contact unit and the beam is improved. In particular, even when the beam or the contact unit under the beam is unbalanced, the contact unit can elastically contact the beam to obtain a stable electrical switching operation.

The article entitled *MEMS, Ka-Band Single-Pole Double-Throw (SPDT) Switch for Switched Line Phase Shifters*, by Scardelletti et al., NASA Glenn Research Center, Cleveland Ohio, 0-7803-7330-8/02 copr. 2002 IEEE is incorporated by reference in its entirety herein. Ka-band MEMS doubly-anchored cantilever beam capacitive shunt devices are used to demonstrate a MEMS SPDT switch fabricated on high resistivity silicon (HRS) utilizing finite ground coplanar waveguide (FGC) transmission lines. The SPDT switch has an insertion loss (IL), return loss (RL), and isolation of 0.3 dB, 40 dB, and 30 dB, respectively at Ka-band.

The article entitled *Ka-Band MEMS Switched Line Phase Shifters Implemented in Finite Ground Coplanar Waveguide*, by Scardelletti et al., NASA Glenn Research Center, Cleveland Ohio., 32nd European Microwave Conference Dig., pp. 797-800, Milan, Italy, Sep. 23-27, 2002, is incorporated by reference in its entirety herein. Ka-band MEMS switched line one and two-bit phase shifters implemented in finite ground coplanar waveguide on High Resistivity Silicon (HRS) substrates are presented. The phase shifters are constructed of two single-pole double-throw (SPDT) switches with additional reference and phase offset transmission line lengths. The MEMS devices are doubly anchored cantilever beam capacitives switches with inductive sections (MEMS LC device); device actuation is accomplished with a 30-volt peak-to-peak AC square wave. The one and two-bit phase shifters have a minimum insertion loss (IL) and a maximum return loss (RL) of 0.85 dB and 30 dB and 1.8 dB and 25 dB respectively. The one-bit phase shifter's designed phase shift is 22.5° and actual measured phase shift is 21.8° at 26.5 GHz. The two-bit phase shifter's designed phase shift is 22.5°, 45°, and 67.5° and the actual measured phase shifts are 21.4°, 44.2°, and 65.8°, respectively, at 26.5 GHZ.

Glossary

Unless otherwise noted, or as may be evident from the context of their usage, any terms, abbreviations, acronyms or scientific symbols and notations used herein are to be given their ordinary meaning in the technical discipline to which the disclosure most nearly pertains. The following terms, abbreviations and acronyms may be used throughout the descriptions presented herein and should generally be given the following meaning unless contradicted or elaborated upon by other descriptions set forth herein. Some of the terms set forth below may be registered trademarks (®).

Alternating Current (AC)—Used to indicate that voltage or current in a circuit that is alternating in polarity at a set frequency, most often 50 or 60 Hz, as typified by current coming out of standard household wall sockets. The "other" type of current that we are familiar with is Direct Current (DC), typified by current coming out of standard household batteries.

Anisotropic—Literally, one directional. An example of an anisotropic process is sunbathing. Only surfaces of the body exposed to the sun become tanned. As used herein, a deposition process may be isotropic, involving material being deposited uni-directionally from above onto horizontal, upward-facing surfaces. Or, an etching process may be isotropic, acting only on surfaces oriented in one direction (such as upward-facing surfaces), compare "isotropic"

Beam—In its usual mechanical (and civil) engineering sense, a beam is a structural element that carries load primarily in bending (flexure). Beams generally carry vertical gravitational forces but can also be used to carry horizontal loads (i.e. loads due to an earthquake). The loads carried by a beam are transferred to columns, walls, or girders, which then transfer the force to adjacent structural compression members. As used herein, and/or in patents and publications referred to herein, the term "beam" may refer to an elongate member portion of a MEMS switch that flexes or deforms. The beam may also be referred to as a "crossbeam".

Bridge—A typically elongate structure extending between two points, typically over a lower elevation topological feature (such as a valley or a river).

Cantilever—A horizontal member fixed at one end and free at the other, which may also extend over a lower elevation topological feature.

Compression—The pushing force which tends to shorten a member; opposite of tension CPW—Short for coplanar waveguide. In electromagnetics and communications engineering, the term waveguide may refer to any linear structure that guides electromagnetic waves. However, the original and most common meaning is a hollow metal pipe used for this purpose. A classic coplanar waveguide (CPW) is formed from a conductor separated from a pair of ground planes, all on the same plane, atop a dielectric medium. In the ideal case, the thickness of the dielectric is infinite; in practice, it is thick enough so that EM fields die out before they get out of the substrate.

CVD—Short for Chemical Vapor Deposition. A process used to deposit any number of materials on a substrate. Various forms of CVD include:

| | |
|---|---|
| APCVD | Atmospheric Pressure CVD |
| SAPCVD | Selected Area CVD |
| LPCVD | Low Pressure CVD |
| PECVD | Plasma-enhanced CVD |
| HDPCVD | High Density Plasma CVD |

Etching—A process whereby material is removed, either by being dissolved (wet etching) or by being vaporized (dry etching).

IC—Short for Integrated Circuit. A monolithic integrated circuit (also known as IC, microcircuit, microchip, silicon chip, computer chip or chip) is a miniaturized electronic circuit (consisting mainly of semiconductor devices, as well as passive components) that has been manufactured in the surface of a thin substrate of semiconductor material.

Ion Implantation—Ion implantation is a materials engineering process by which ions of a material can be implanted into another solid, thereby changing the physical properties of the solid. Ion implantation is used in semiconductor device fabrication and in metal finishing, as well as various applications in materials science research. The ions introduce both a chemical change in the target, in that they can be a different element than the target, and a structural change, in that the crystal structure of the target can be damaged or even destroyed.

Isotropic—Literally, identical in all directions. An example of an isotropic process is dissolving a tablet in water. All exposed surfaces of the tablet are uniformly acted upon. (compare "anisotropic")

Latin—A language. Some Latin terms (abbreviations) may be used herein, as follows:

cf. Short for the Latin "confer". As may be used herein, "compare".

e.g. Short for the Latin "exempli gratia". Also "eg" (without periods). As may be used herein, means "for example".

etc. Short for the Latin "et cetera". As may be used herein, means "and so forth", or "and so on", or "and other similar things (devices, process, as may be appropriate to the circumstances)".

i.e. Short for the Latin "id est". As may be used herein, "that is".

Lithography or photolithography—Photolithography (also optical lithography) is a process used in microfabrication to selectively remove parts of a thin film (or the bulk of a substrate). It uses light to transfer a geometric pattern from a photomask to a light-sensitive chemical (photoresist, or simply "resist") on the substrate. A series of chemical treatments then engraves the exposure pattern into the material underneath the photoresist. In a complex integrated circuit (for example, modern CMOS), a wafer will go through the photolithographic cycle up to 50 times.

MEMS—Short for MicroElectroMechanical System.

Micron or μm—unit of length, one-millionth of a meter.

Oxide—Common name for silicon dioxide ($SiO_2$), or silica. A very high quality insulator. SiO2 is the most common insulator in semiconductor device technology, particularly in silicon MOS/CMOS where it is used as a gate dielectric (gate oxide); high quality films are obtained by thermal oxidation of silicon. Thermal SiO2 forms a smooth, low-defect interface with Si, and can be also readily deposited by CVD. Some particular applications of oxide are:

LV Oxide short for low voltage oxide. LV refers to the process used to deposit the oxide.

HV Oxide short for high voltage oxide. HV refers to the process used to deposit the oxide STI Oxide short for shallow trench oxide. Oxide-filled trenches are commonly used to separate one region (or device) of a semiconductor substrate from another region (or device).

PAA—Short for phased array antenna. An antenna that has a radiation pattern determined by the relative phases and amplitudes of the currents on the individual antenna elements. The direction of the antenna pattern can be steered by properly varying the relative phases of those elements.

Photoresist or simply "resist"—Sometimes abbreviated "PR". Photoresist is a light-sensitive material used in several industrial processes, such as photolithography and photoengraving to form a patterned coating on a surface. Photoresists are classified into two groups, positive resists and negative resists.

A positive resist is a type of photoresist in which the portion of the photoresist that is exposed to light becomes soluble to the photoresist developer and the portion of the photoresist that is unexposed remains insoluble to the photoresist developer.

A negative resist is a type of photoresist in which the portion of the photoresist that is exposed to light becomes relatively insoluble to the photoresist developer. The unexposed portion of the photoresist is dissolved by the photoresist developer.

RF—Short for radio frequency. RF refers to that portion of the electromagnetic spectrum in which electromagnetic waves can be generated by alternating current fed to an antenna. Various "bands" are of interest here, including:

Super high frequency (SHF) 3-30 GHz used for microwave devices, mobile phones (W-CDMA), WLAN, most modern radars Ultra high frequency (UHF) 300-3000 MHz used for television broadcasts, mobile phones, wireless LAN, ground-to-air and air-to-air communications Sapphire—Single-crystal Al2O3; can be synthesized and processed into various shapes; highly resistant chemically; transparent to UV radiation.

Semiconductor—Any of various solid crystalline substances, such as silicon or germanium. Unlike metals or insulators, the electrical conductivity of semiconductors can be greatly affected by adding very small amounts of dopants.

Si—"Si" is the chemical symbol for silicon, an element useful as a semiconductor.

SiC—Short for Silicon Carbide, or simply "carbide". SiC is a non-metallic conductor. Silicon carbide, almost as hard as diamond, is often used as an abrasive.

Spin-On—A process used to coat a wafer with material which is originally in a liquid form; liquid is dispensed onto the wafer surface in predetermined amount and the wafer is rapidly rotated (up to 6000 rpm; during spinning liquid is uniformly distributed on the surface by centrifugal forces; material is then solidified by low temperature (typically <200-degrees C.) bake; in semiconductor processing, spin-on is commonly used to apply photoresist.

Substrate—Term commonly applied to a semiconductor wafer being processed (doped, diffused, deposited, etched, etc.) to have semiconductor devices.

Switches—In its usual electrical engineering sense, a switch is a device for changing the course (or flow) of a circuit—in other words, connecting or disconnecting two terminals, or making/breaking a connection. In the early days of electricity, switches were mechanical devices. In many electronic applications, mechanical switches have long been replaced by electronic variants, such as transistors and other semiconductor devices, which can be intelligently controlled and automated. A simple switch is an on/off device, which may be termed "SPST" (single pole, single throw). The following are common abbreviations for some switches.

SPST—Short for single pole, single throw. A simple on-off switch: The two terminals (contacts) are either connected together or not connected to anything. An example is a simple light switch. Usually, only one of the terminals is movable (if it is a mechanical switch), the other is fixed (stationary, non-movable).

SPDT—Short for single pole, double throw Sometimes referred to as a changeover switch. The common "pole" terminal is connected to either of two other terminals, and can be "thrown" in either direction.

DPST—Short for double pole, single throw. Equivalent to two SPST switches controlled by a single mechanism Tension—The pulling force that tends to lengthen a member; opposite of compression.

Voltage—Abbreviated "v", or "V". Voltage is a measurement of the electromotive force in an electrical circuit or device expressed in volts. It is often taught that voltage can be thought of as being analogous to the pressure (rather than the volume) of water in a waterline.

Wafer—A thin, circular slice (disc) of semiconductor material, typically sliced from an ingot. By processing and fabrication, many (hundreds or thousands of) semiconductor devices, such as DRAM devices, can be formed on a single wafer. The devices are eventually singulated (separated) from one another, and are then referred to as "chips".

Wet Etching—Removal of material using solvents (etchants), such as nitric, acetic, and hydrofluoric acids Young's modulus—In solid mechanics, Young's Modulus (E) (also known as the Young Modulus, modulus of elasticity, elastic modulus or tensile modulus) is a measure of the stiffness of a given material. It is defined as the ratio, for small strains, of the rate of change of stress with strain. This can be experimentally determined from the slope of a stress-strain curve created during tensile tests conducted on a sample of the material. Young's modulus is named after Thomas Young.

SUMMARY OF THE INVENTION

According to the invention, generally, an improved RF MEMS switch utilizes stress and conductivity-controlled, non-metallic, thin cantilevers and/or bridges. As used herein, a cantilever is an elongate beam supported at one end, and a bridge is an elongate beam supported at both ends. Generally (except for the number of supports), the techniques for fabricating the switch are identical for bridges and cantilevers, except as otherwise may be noted as specific to the cantilever or the bridge construction.

The switch may be fabricated with conventional silicon (Si) integrated circuit (IC) processing techniques, which makes it a low cost device. The design of the switch is very versatile and can be implemented in many transmission line (TL) mediums.

The non-metallic thin film bridge/cantilevers may comprise silicon carbide (SiC), which demonstrates controlled stress and conductivity. SiC is most widely known as a structural material for MEMS devices designed to operate in harsh environments, such as high temperature, radiation, wear, etc. However, SiC is also attractive in RF MEMS applications, due to its high Young Modulus-to-density ratio. When used as the structural material in micromachined bridges/cantilevers, the inherent stiffness and tensile stresses of SiC will result in beams that are completely resistant to sagging and failure. This property makes SiC an ideal alternative to metals in bridge-based RF MEMS switches, which currently suffer from severe sagging and failure during operation. Moreover, SiC is highly resistant to oxidation which, when coupled with its overall chemical resistance, makes SiC surfaces virtually stiction-free, a significant advantage when the material is to be fabricated into narrow gapped, micromachined bridges for use as contact switches.

A thin metal layer is placed over the SiC bridge, for biasing the device. The supporting layer of SiC would physically contact the center conductor. Use of SiC for the bridge/cantilever would forestall metal fatigue, and enables a low-voltage DC bias for actuation, while enabling well-known and economical CMOS manufacturing methods. SiC is also very hard and strong, chemically inert, and resistant to stiction. (Applying appropriate voltages causes an attractive force deforming the elongate beam of the cantilever/bridge.)

Incorporation of non-metallic thin films such as SiC as the main mechanical structure in bridge-based RF switches eliminates the need to use a stiction-preventing insulating film between the bridge and transmission line, because the SiC itself is highly resistant to stiction, due to its chemical inertness coupled with its resistance to oxidation. As a result only a low voltage DC bias is needed to actuate the SiC MEMS device, whereas all capacitive MEMS switches (MEMS devices which require an insulator to prevent stiction) require a low frequency peak-to-peak voltage waveform to prevent charge trapping which seriously degrades the performance of the switch and complicates the biasing structure of the overall system. In use, the beam of the bridge/cantilever deflects (when biased) and touches the transmission lines, shorting them out.

Due to the physical properties of the non-metal SiC film, the switch can withstand and operate in harsh environments as well as survive high power applications. This may include wireless sensor applications for aircraft or rocket engines as well as for internal switching application within the engines themselves. Also, the RF MEMS switch device disclosed herein has the potential to be the first extremely low loss MEMS device that can be space qualified.

The RF MEMS switch disclosed herein utilizes bridges/cantilevers constructed from Silicon Carbide (SiC). In general, these switches consist of a single or double supported cantilever suspended over a microwave transmission line. In its "up" state, the cantilever is several microns above the transmission line and does not affect the electromagnetic fields flowing through the transmission lines. When the actuation voltage is applied between the cantilever and transmission lines, the cantilever is pulled "down" and makes contact with the circuit just as with a typical MEMS switch. The SiC film is non metallic so there is no welding problem which occurs with the metal-to-metal type MEMS switches after prolonged use, and therefore the reliability of the life time of the switch is dramatically increased. Furthermore, because SiC is conductive, due to ion implantation, and takes the place of the insulating film found in capacitive MEMS switches, the switch requires only a DC actuation voltage to operate.

In simulations, the RF MEMS switch device disclosed herein demonstrated a negligible insertion loss of less than 0.1 dB, a return loss of more than 30 dB and isolation better than 40 dB over a bandwidth of 0 to 50 GHz.

The MEMS switching device(s) disclosed herein can replace semiconductor switches in applications where sub-microsecond switching speed is not essential. The devices can be assembled into various types of switch configuration such as single-pole single-throw (SPST), single-pole double-throw (SPDT), and up to nth-throw as long as the layout of the circuit does not interfere with device performance. One application would be to use the MEMS switches in phase shifters for phased array antennas used in wireless communication systems, satellite communications systems and radar applications. Other applications include, but are not limited to, using the device in filter banks, programmable attenuators, and the switching mechanism for transmitting and receiving modules for wireless communication systems.

The use of the non-metallic structures greatly improves the RF characteristics and operational reliability of the switch. The switch can be fabricated with conventional silicon (Si) integrated circuit (IC) processing techniques which makes it a low cost device. The deign of the switch is very versatile and can be implemented in many transmission line (TL) mediums.

There are numerous applications for this technology. One application is its use in phase shifters for phase array antennas used in wireless communication systems, satellite communications systems and radar applications. Other applications include filter banks, programmable attenuator, and the switching mechanism for transmit and receive modules for wireless communication systems.

Current phase shifters typically incorporate GaAs (III-V material series) switches which are very costly to fabricate, require special packaging, and very lossy. The RF MEMS switch disclosed herein can be used in place of the III-V series based switch in phase shifters and this will greatly reduce the cost to manufacture the phase shifters since only conventional Silicon (Si) integrated circuit (IC) fabrication processing techniques are required. This alone reduces the phase shifter cost by a factor of 10. Secondly, the resulting phase shifter will exhibit extremely low loss, which translates into phase array antennas with a reduced number elements and twice the data rate.

According to the invention, an RF MEMS switch comprises: a crossbeam, which is an elongate member having two ends, comprising silicon carbide (SiC), and extending transversely over and above a plurality of transmission lines; and means for biasing the crossbeam, causing an electrostatic force to deflect the crossbeam to contact at least one of the transmission lines. Generally, the switch and transmission lines are on a surface of a substrate, such as sapphire.

The switch may further comprise at least one layer of metal disposed on a top surface of the SiC crossbeam, such as a layer of chromium followed by a layer of gold, and extending beyond the switch to a biasing pad on the substrate.

The transmission lines may comprise a center conductor disposed between two ground planes, forming a coplanar waveguide (CPW).

The crossbeam may have a maximum thickness of approximately 2 microns. The crossbeam may further comprise at least one leg extending from at least one end of the crossbeam, to a surface of an underlying substrate, and supporting the crossbeam above the surface of the substrate, as well as above the plurality of transmission lines. The at least one leg may be formed integrally with the crossbeam.

BRIEF DESCRIPTION OF THE DRAWING(S)

Reference will be made in detail to embodiments of the disclosure, examples of which may be illustrated in the accompanying drawing figures (FIGs). The figures are intended to be illustrative, not limiting. Although the invention is generally described in the context of these embodiments, it should be understood that it is not intended to limit the invention to these particular embodiments.

Certain elements in selected ones of the figures may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity. In some cases, hidden lines may be drawn as dashed lines (this is conventional), but in other cases they may be drawn as solid lines.

If shading or cross-hatching is used, it is intended to be of use in distinguishing one element from another (such as a cross-hatched element from a neighboring un-shaded element. It should be understood that it is not intended to limit the disclosure due to shading or cross-hatching in the drawing figures.

Elements of the figures may (or may not) be numbered as follows. The most significant digits (hundreds) of the reference number correspond to the figure number. For example, elements of FIG. 1 are typically numbered in the range of 100-199, and elements of FIG. 2 are typically numbered in the range of 200-299. Similar elements throughout the figures may be referred to by similar reference numerals. For example, the element 199 in FIG. 1 may be similar (and possibly identical) to the element 299 in FIG. 2. Throughout the figures, each of a plurality of elements 199 may be referred to individually as 199*a*, 199*b*, 199*c*, etc. Such relationships, if any, between similar elements in the same or different figures will become apparent throughout the specification, including, if applicable, in the claims and abstract.

FIGS. 1A-1D, 2, 3A-3C, 4A-4E, and 5A-5D are cross-sectional views illustrating an embodiment of a process for fabricating a SiC M EMS switch, according to the invention.

DETAILED DESCRIPTION OF THE INVENTION

Figure 1A:
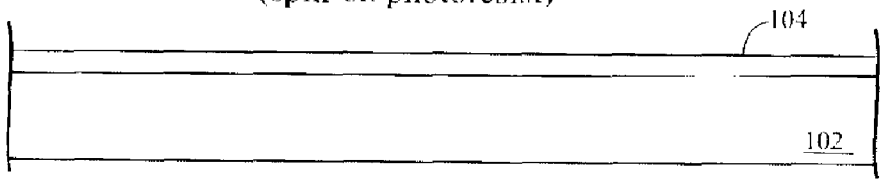

Throughout the descriptions set forth herein, lowercase numbers or letters may be used, instead of subscripts. For example Vg could be written $V_g$. Generally, lowercase is preferred to maintain uniform font size.) Regarding the use of subscripts (in the drawings, as well as throughout the text of this document), sometimes a character (letter or numeral) is written as a subscript—smaller, and lower than the character (typically a letter) preceding it, such as "$V_s$" (source voltage) or "$H_2O$" (water). For consistency of font size, such acronyms may be written in regular font, without subscripting, using uppercase and lowercase—for example "Vs" and "H2O".

Although various features of the invention may be described in the context of a single embodiment, the features may also be provided separately or in any suitable combination. Conversely, although the invention may be described herein in the context of separate embodiments for clarity, the invention may also be implemented in a single embodiment. Furthermore, it should be understood that the invention can be carried out or practiced in various ways, and that the invention can be implemented in embodiments other than the exemplary ones described hereinbelow. The descriptions, examples, methods and materials presented in the in the description, as well as in the claims, should not be construed as limiting, but rather as illustrative.

If any dimensions are set forth herein, they should be construed in the context of providing some scale to and relationship between elements. For example, a given element may have an equal, lesser or greater dimension (such as thickness) than another element. Any dimensions or relationships that are important or critical will generally be identified as such. The term "at least" includes equal to or greater than. The term "up to" includes less than. If any ranges are set forth herein, such as 1-10 microns, sub-ranges are implied, if not expressly set forth, such as 1-5 microns, 6-10 microns, 3-8 microns, 4-6 microns, etc. Also, an open-ended range or ratio such as "at least 2:1", should be interpreted to include sub-ranges such as at least 3:1, at least 5:1, and at least 10:1.

FIGS. 1A-1D, 2, 3A-3C, 4A-4E, and 5A-5D illustrate an embodiment of a process for fabricating a SiC MEMS switch.

FIG. 1A illustrates a first step in the process. Starting with a substrate 102, such as sapphire, a layer of photoresist 104, such as AZ5218 is deposited on the substrate 102, using a conventional process such as spin-on photoresist. A thickness for the photoresist 104 may be in the range of approximately 0.5 to 2.5 microns, typically 1.5 microns.

Sapphire is desirable for a substrate material because it is resistant to many etches, and doesn't etch away like silicon. Also, if using silicon, a barrier layer may be required to prevent voltage leakage into the silicon substrate. Other substrate materials may be used, such as alumina, quartz diamond film, and the like.

Figure 1B:
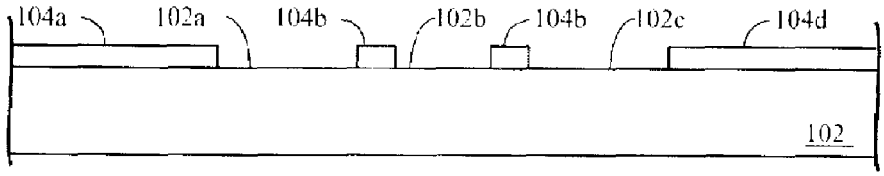

FIG. 1B illustrates a next step in the process. The photoresist 104 is patterned, using a conventional process such as image reversal lithography. This results in portions 104*a*, 104*b*, 104*c*, 104*d* of the substrate covering corresponding (underlying) portions of the substrate 102, and the remainder (rest of) the substrate, the three areas 102*a*, 102*b*, 102*c*, are not covered by photoresist 104.

Figure 1C:
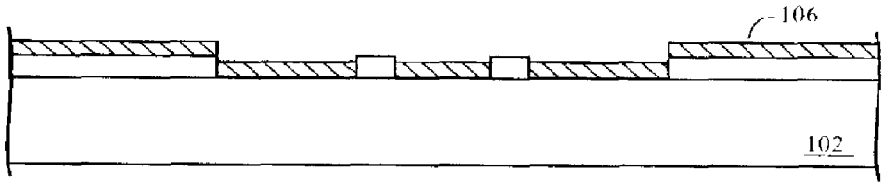

FIG. 1C, illustrates depositing metal 106 such as Chromium/Gold (Cr/Au), using a process such as E-beam evaporation deposition. A portion of the metal 106 is on photoresist (104*a*, 104*b*, 104*c*, 104*d*), a remaining portion (the rest) of the metal is on the substrate 102 in the areas 102*a*, 102*b*, 102*c* that are not covered by photoresist (104). For example, 2 nanometers of Cr as an adhesion layer to silicon, followed by 1.4 microns (micrometers) of Au. The Au improves conductivity, doesn't oxidize, and can be deposited at low temperature. Other metals such as silver and platinum, as well as tungsten may be used.

Figure 1D:
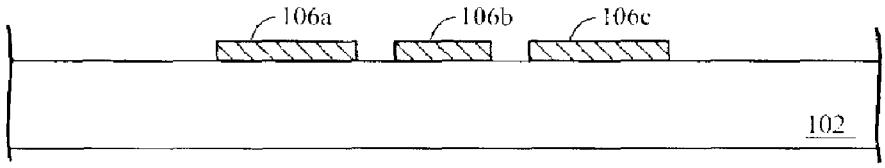

FIG. 1D illustrates a next step in the process, and an interim product resulting therefrom. The photoresist 104 and the metal 106 which is on the photoresist 104 is removed, using a conventional liftoff process. The metal 106 in the areas 102*a*, 102*b*, 102*c* which were not covered by photoresist 104 remain adhered to the substrate 102, resulting in three metal lines (or conductors) 106*a*, 106*b*, 106*c* which may serve as a coplanar waveguide (CPW). The conductor 106*b* may be referred to as the "center conductor" or "transmission line". The three lines 106*a*, 106*b*, 106*c* are substantially parallel with one another, maintaining a constant spacing therebetween (see also FIG. 6).

The metal lines 106*a*, 106*b*, 106*c* have an exemplary thickness (vertical, as viewed in the figure) of 1.4 microns, width (across the sheet of the figure, as viewed) of 2(S+2W), and may extend as long as required (in a direction into the sheet of the figure). If there is oxide (such as with a silicon substrate, but not present on sapphire) in the gaps between the metal lines, it should be etched out, using a conventional oxide removal process.

Figure 2:
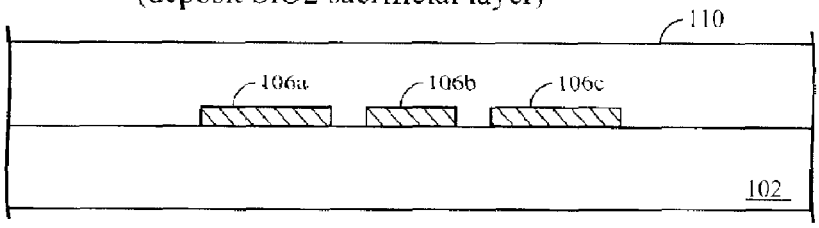

FIG. 2 illustrates a next step in the process. A layer 110 of a material, such as silicon dioxide (SiO2, or simply "oxide") is deposited over the entire substrate, using a conventional process such as PECVD (plasma enhanced chemical vapor deposition). The layer 110 is what is termed a "sacrificial" layer, the purpose of which will become evident from the following discussion. The layer 110 may have a thickness of 4 microns. At this stage of the process, an interim product metal comprises lines 106*a*, 106*b*, 106*c* on a sapphire substrate 102, covered by a sacrificial layer 110 of silicon dioxide. The layer 110 may be at least 3-4 microns thick, and establishes the height of the resulting bridge/cantilever. The layer 110 may be thicker if a wider bridge is desired. It may (or may not) be CMP (chemical-mechanical polished) for flatness.

Figure 3A:
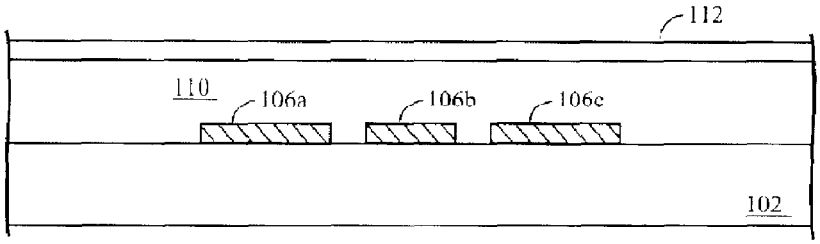
Figure 3B:
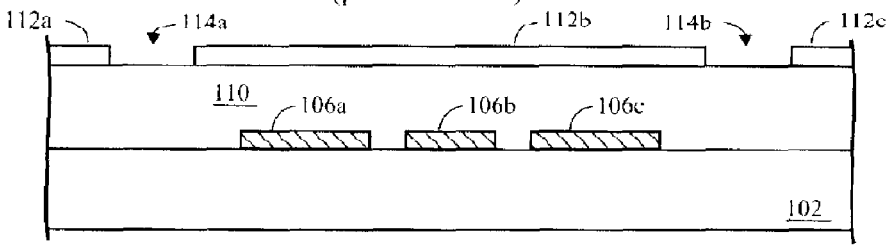
Figure 3C:
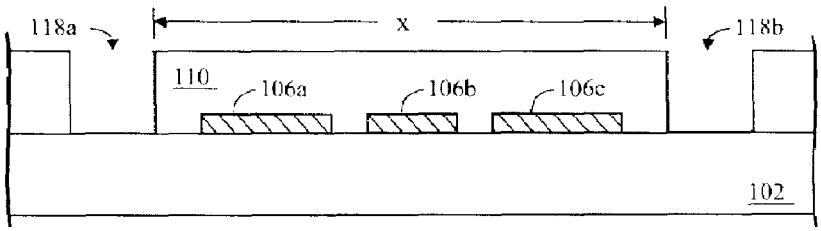

In a next sequence of steps illustrated in FIGS. 3A-3C, one or more "posts" (which may also be referred to as a supports, or anchors) are defined for a crossbeam. It the crossbeam is supported at both ends, it is usually termed a "bridge". If the crossbeam is supported at only one end, it is usually termed a "cantilever". In the main, hereinafter, a bridge construction is discussed.

FIG. 3A illustrates a next step in the process. A layer 112 of photoresist is applied, again such as by a conventional spin-on process. (Compare FIG. 1A)

FIG. 3B illustrates a next step in the process. The photoresist 112 is patterned, using a conventional lithography process, resulting in portions 112*a*, 112*b*, 112*c*, and openings 114*a*, 114*b* at locations whereat it is desired to form holes (or slots) in (through) the underlying sacrificial layer 110, in a subsequent step. In a subsequent step, the holes will be filled to form supports at the end of the cantilever/bridge crossbeam—whereas two holes (for two supports) are needed for a bridge crossbeam (supported at both ends), only one hole (for one support) is needed for a cantilever crossbeam (supported at only one end).

Generally, the relationship of the openings 114*a* and 114*b* to the metal lines 116*a*, 116*b*, 116*c* is that the lines will be within a space between two holes which will be formed in the sacrificial layer 110 under the openings 114*a* and 114*b*, and under a bridge spanning the two holes. As will become evident, the process being described herein is for an exemplary bridge structure having a single, elongate span having two opposite ends, and posts (anchors, supports) supporting the ends of the elongate span.

FIG. 3C illustrates a next step in the process. For one (each) bridge, two holes (or slots) 118*a*, 118*b* are etched in (through) the sacrificial layer 110, stopping on the substrate 102, such as by using a conventional wet etch process, such as buffered oxide etch. The photoresist 112 is removed. In this figure, two holes are shown for forming supports (in a subsequent step) for both ends of a bridge crossbeam, only one hole would required for forming a support for the supported end of a cantilever crossbeam.

The holes 118*a*, 118*b* may be rectangular or square in profile (top view), measuring 100 to 400 microns across. Generally, aside from their height, the most important parameter of post geometry is that they are large enough (hence, sufficiently anchored to the substrate) that they won't pop up when stressed by switch operation.

The height of the holes 118*a*, 118*b* is determined by the thickness of the sacrificial layer 110, and in this example is 3-4 microns.

A distance "x" between the two holes 118*a*, 118*b* may be approximately 5-20 microns, preferably about 10 microns, and is suitably measured either from center-to-center of the holes, or from an inner (closest to the other hole) edge of one hole to the inner edge of the other hole. (The latter is shown in the figure, since this will represent the unsupported span of the bridge crossbeam.) It should be noted, if there is only going to be one hole, and one support, for a cantilever crossbeam, the dimension "x" represents the length of the crossbeam.

Generally, if "x" is too great, the crossbeam will be too long, and the reliability of the bridge/cantilever may be degraded in that there may not be enough restoring force to pull it back up (after deflecting downward, as discussed below). On the other hand, if "x" is too short, the crossbeam may be too stiff to deflect downward to contact the transmission line(s).

Next, in the steps illustrated by FIGS. 4A-4F, a bridge (crossbeam) of Silicon Carbide (SiC) is formed, having a span extending between the two holes 118*a*, 118*b*. It should, of course, be understood that the example set forth herein is for making one bridge, and can readily be extended to making many bridges or cantilevers.

Figure 4A:
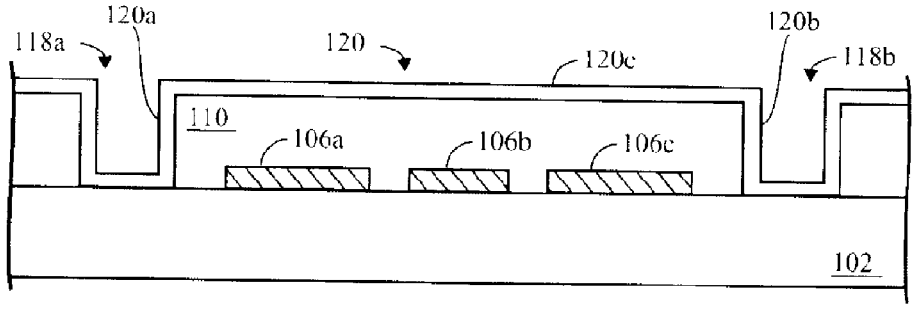

FIG. 4A illustrates a next step in the process. A thin layer (film) 120 of Silicon Carbide (SiC) is deposited, using a conventional process such as PECVD, to a thickness of approximately 0.1 to 1 microns. The deposited SiC covers the oxide layer 110 including sidewalls of the holes 118*a*, 118*b*, and the exposed surface of the substrate 102 at the bottom of the holes 118*a*, 118*b*. Although the holes are shown as being only partially filled, they may be fully filled in this step.

A portion 120*c* of the SiC film 120 spanning the distance between the two holes 118*a*, 118*b* comprises what is considered to be the "span" of the bridge. The portions 120*a* and 120*b* of the SiC film 120, extending through the two holes

118*a* and 118*b*, respectively, comprise what is considered to be the "posts" (or anchors, or supports) for the bridge. An important feature to take note of here is that the span portion 120*c* of the bridge 120 is located atop (above) the metal lines 116*a*, 116*b*, 116*c*.

It can be noted here that the elongate bridge is oriented transverse (substantially at 90 degrees with respect to) the transmission lines 106*a*, 106*b*, 106*c*. This is important to maintain 3-4 micron height over CPW including 106*a*, 106*b* and 106*c*.

It can also be noted here that the crossbeam 120*c* (see also 130, below) and posts 120*a* and 120*b* are formed as a single unit, from a single material, in a single process step. This is intended to anneal the stress out of the entire film 120 so there is no stress in the anchors. It is desired that, after deflection, the crossbeam will restore itself (pull up) by itself (when the bias causing deflection is removed), without the need for any additional (such as opposite polarity) bias.

SiC is chosen for the structure of the bridge because it is a non-metallic conductor, and does not exhibit stiction when welding w/the transmission line. The SiC may be shown cross-hatched (see, FIG. 4D), for illustrative clarity, and to indicate that it can function as a quasi electrical conductor upon doping, although it is not a metal (non-metallic).

Figure 4B:
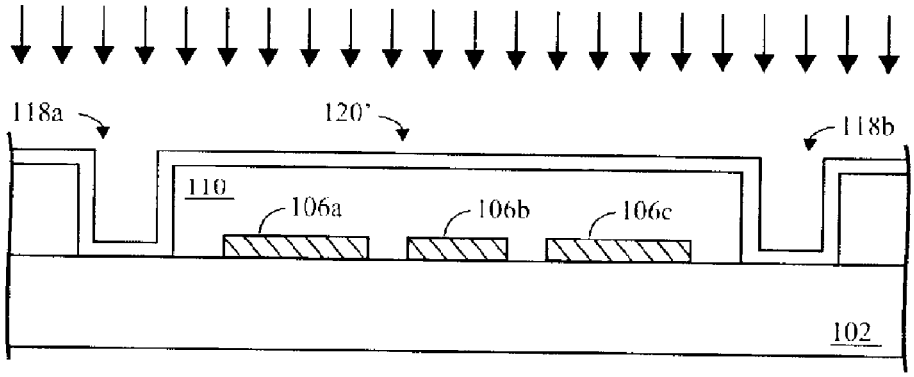

FIG. 4B illustrates a next step in the process. The film 120 of SiC is implanted, using a conventional process such as ion implantation, such as with nitrogen, borine, or phosphorous, at a concentration of $10^{15}$-$10^{21}$ atoms/cm$^3$, power setting 25 Kev to 360 KEV (Kilovolts) at room temperature The purpose of ion implantation is to control the electrical conductivity of the SiC. For example, from an initial conductivity of $10^9$ ohms, after the implant the SiC can exhibit a resistivity in the range of 100-5000 ohms. Since the film 120 of SiC has been modified (implanted), it is referenced in this figure with a primed number, 120'.

Figure 4C:
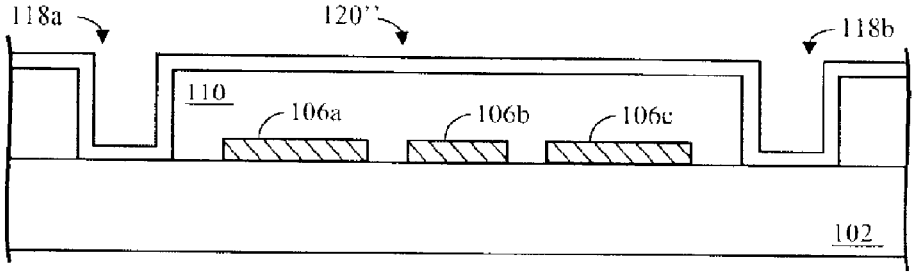

FIG. 4C illustrates a next step in the process. The ion-implanted SiC film 120' is annealed, to relieve (control) stress, using a conventional process such as elevating the temperature of the product to 450-degrees Celsius for one hour. (The thickness of the SiC thin film will also determine its stress characteristics.) Since the film 120' of SiC has been modified, it is referenced in this figure with a double-primed number, 120".

Figure 4D:
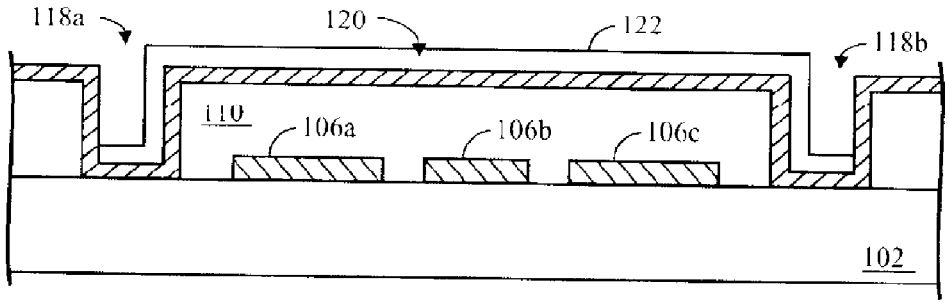

FIG. 4D illustrates a next step in the process, which basically leads to removing excess SiC and patterning the resulting bridge structure. A layer of photoresist is deposited, such as by using a conventional spin-on process, and is patterned, such as by using a conventional photolithographic process (expose, rinse). The patterned photoresist 122 covers (i) the elongate portion (120*c*) of the bridge, (ii) bridge material (SiC) which is on the inner sidewall of each hole 118*a*, 118*b* (the "inner" sidewall of a hole is defined as the sidewall closest to the opposite hole at the other end of the elongate portion), and (iii) bridge material which is at the bottom of the holes 118*a*, 118*b*, and may also cover additional bridge material such as (iv) bridge material which is on other than the inner sidewalls of the hole(s).

Figure 4E:
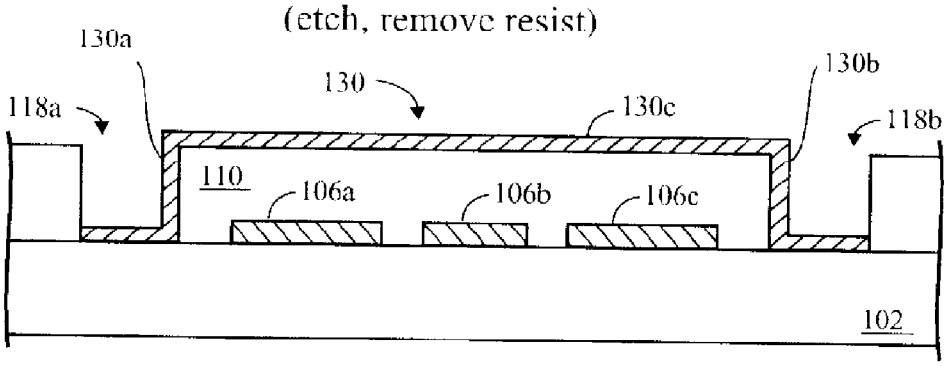

FIG. 4E illustrates a next step in the process. The SiC (120") is etched to form a bridge structure 130, using a conventional plasma etch process such as SF6 (sulfur hexafluoride). And, the photoresist is removed.

The remaining SiC (120") comprises an elongate span portion 130*c* (compare 120*c*) which extends between the two holes 118*a*, 118*b* in the sacrificial layer 110. At one end of the elongate span 130*c* (compare 120*c*; FIG. 4A), a post (or leg) 130*a* (compare 120*a*; FIG. 4A) extends through the hole 118*a* to the substrate 110. At the opposite end of the elongate span 130*c*, a post (or leg) 130*b* (compare 120*b*; FIG. 4A) extends through the hole 118*b* to the substrate 110. In this example, the posts 130*a*, 130*b* each resemble a leg and a foot, and are illustrated extending into the respective hole 118*a*, 118*b* and resting on the surface of the substrate 110.

It can be very well seen here that the crossbeam 130*c* and legs 130*a* and 130*b* at the two ends of the crossbeam 130*a* are formed as a single unit, from a single (cross-hatched, but non-metallic) material in a series of the same process steps, particularly the same deposition step (FIG. 4A).

The span portion (crossbeam) 130*c* may have a thickness of approximately 0.5 microns (as set forth above), a length approximately equal to 80 microns to 1000 microns (which is "x", the distance between the two holes 118*a*, 118*b*), and a width (into the page, as viewed) of approximately 30 microns.

The leg portions 130*a*, 130*b* may have a thickness of approximately 0.5 microns (as set forth above), a length of approximately 3 to 4 microns (substantially equal to the thickness of the sacrificial layer 110) and a width (into the page, as viewed) of approximately 30 to 400 microns (equal to the width of the span portion of the bridge structure).

At this point in the process, a "bridge", or "bridge structure", or "crossbeam" has been built, which is a key component of a switch, or switching device, such as to form an RF MEMS switch, as described in the following steps.

An important feature of the resulting switch is that the crossbeam 130*c* extends transversely directly above and across the transmission lines 106*a*, 106*b*, 106*c* (which form a CPW).

Figure 5A:
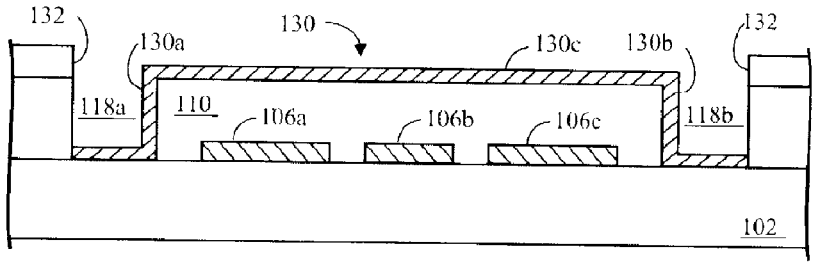

FIG. 5A illustrates a next step in the process. A layer of photoresist 132 is deposited, such as using a conventional spin-on process, and is patterned, using a conventional photolithographic process. This results in photoresist everywhere except for on the bridge structure 130 which is exposed, including top and side surface of the legs 130*a*, 130*b*.

Figure 5B:
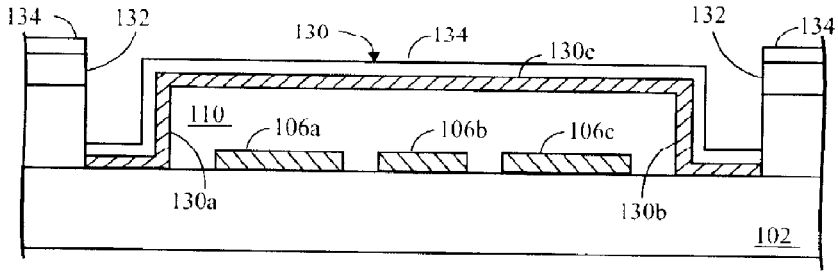

FIG. 5B illustrates a next step in the process. Bridge metal 134 is deposited, such as layer of chromium (Cr) having a thickness of approximately 350 (Angstroms), followed by a layer of gold (Au) having a thickness of approximately 1500 Angstroms (these two layers are shown as a single layer 134), using a conventional process such as image reversal liftoff. Here it can be seen that there is bridge metal over the photoresist 132, and bridge metal on top of all of the exposed surfaces of the SiC bridge structure 130, including the span and leg portions (posts). The bridge metal 134 is on the top (away from the transmission lines) surface of the SiC and, as will be seen in FIG. 6, extends down one leg of the bridge structure and further to a bias pad providing the necessary voltage to cause the crossbeam to electrostatically deflect.

Generally, it is desired that the metal layers be as think as possible so as not to affect the mechanical properties of the SiC crossbeam. Also, the metal layers are generally thinner (less wide) than the SiC crossbeam (this is more visible in FIG. 6) so the during processing, metal doesn't fall over the bridge due to possible fabrication errors (imprecision). Generally, the principal purpose of the metal is to supplant the limited conductivity of the SiC, and to do so without adversely affecting the mechanical properties of the bridge/cantilever crossbeam.

Figure 5C:
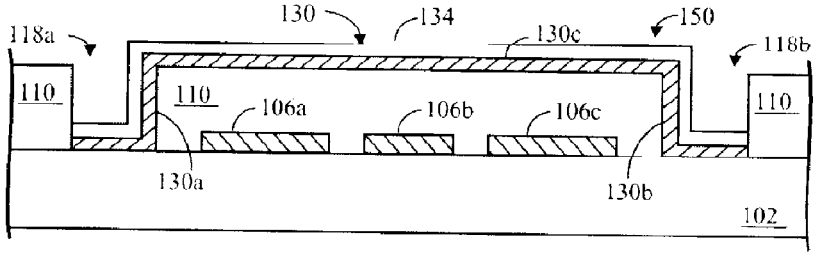

FIG. 5C illustrates a next step in the process. Excess bridge metal 134, which is the bridge metal on resist 132, is lifted off. (compare step/FIG. 1D). The resulting bridge structure 150 (comprising SiC 130 and bridge metal 134) is almost complete, except that there is still sacrificial oxide 110 under the span (crossbeam) of the bridge, which would prevent it from flexing and contacting the underlying metal lines 106*a*, 106*b*,

106*c*. It is important that the bridge metal does not have any effect on electromagnetic propagation through transmission lines.

Next, 1.5 microns of gold (not shown) may be added to the CPW (coplanar wave guide) transmission lines 106*a*, 106*b*, 106*c* everywhere except for under the bridge (130/134).

Figure 5D:
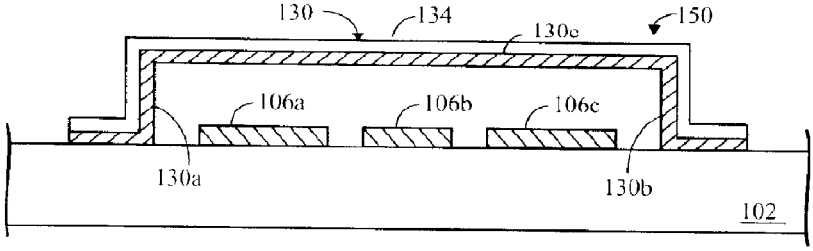

FIG. 5D illustrates a next (final) step in the process of making the bridge structure 150. The sacrificial oxide layer 110 is removed, using a conventional process such as etching with a buffered oxide etch (BOE) for 8 hours.

The resulting bridge structure 150 comprises an elongate structure of SiC 130 having a span (or beam) 130*c* and two legs (or posts, or anchors, or supports) 130*a*, 130*b* at opposite ends of the span 130*c*, covered with metal 134, and disposed atop (above) and across (transverse to) metal lines 106*a*, 106*b*, 106*c* which form a coplanar waveguide (CPW).

The legs 130*a*, 130*b* are formed integrally with the crossbeam 130*c*, and extend generally at 90 degrees from the crossbeam 130*c*, from the crossbeam to the substrate, provide support for the crossbeam and establish the nominal height of the crossbeam over the transmission lines. If there are legs at both ends of the crossbeam it is a "bridge", and if there is only one leg at one end of the crossbeam, and the other end is unsupported, it is a "cantilever" (not shown).

Figure 6:
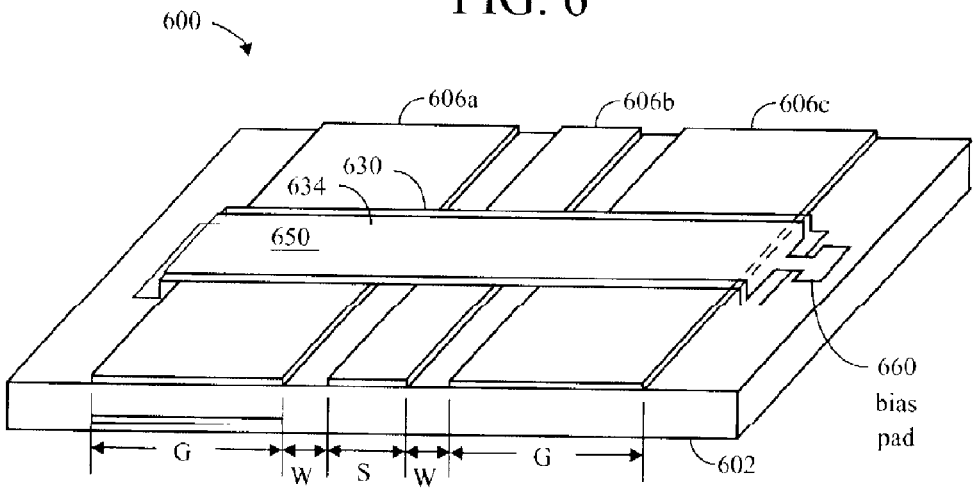
FIG. 6 is a perspective view of a completed SiC MEMS switch, according to the invention.

FIG. 6 illustrates an embodiment of a completed RF MEMS switch 600 utilizing non-metallic, thin film SiC crossbeam (shown in a bridge configuration) with controlled stress and conductivity.

Metal lines 606*a*, 606*b*, 606*c* (compare 106*a*, 106*b*, 106*c*) are disposed on a high resistivity sapphire substrate 602 (compare 102), forming a finite ground, coplanar waveguide (CPW). The metal lines 606*a*,606*b*,606*c* are substantially parallel to each other, and in aggregate may be referred to as "transmission lines".

The line 606*a* serves as a ground plane conductor for the CPW, and has a width G, such as 2(s+w) microns. Similarly, the line 606*c* serves as a ground plane conductor for the CPW, and has a width G, such as 5-400 microns. The line 606*b* serves as a center conductor for the CPW, and has a width X, such as 40-150 microns. The center conductor 606*b* is disposed substantially between the two ground plane conductors 606*a* and 606*c*, spaced a distance W, such as 20-100 microns from the respective ground plane conductor.

A bridge 650 (compare 150) is formed on the substrate 602, spanning (extending over) the ground planes 606*a*, 606*c* and center conductor 606*b*—in other words, over a portion of the CPW, and comprises an SiC structure 630 (compare 530) with an overlying metal layer 634 (compare 534).

The metal layer 634 may extend further than (beyond) the SiC structure, to make contact with a contact pad (actuation electrode) 660, for providing bias to the bridge 650. (The contact pad 660 is connected to other circuitry, not shown, for controlling actuation of the switch.) Alternatively, the metal layer 534 could be connected to the contact pad in a separate metallization step, connecting the right hand "foot" of the metal layer 634 to the contact pad 660.

It is only necessary to have one contact pad, which is shown on the right side (as viewed) of the bridge. Although not shown, if desired, an additional contact pad could be implemented on the other side, and the metal layer 634 could extend to the second contact pad.

A Cantilever Construction

Figure 7A:
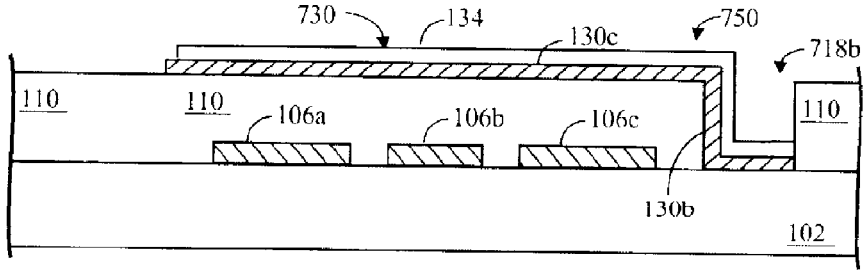
FIG. 7A is a cross-sectional view illustrating a crossbeam supported at only one end—a "cantilever" construction, according to an embodiment of the invention.

There has been illustrated, and described, hereinabove, a crossbeam supported at both ends—a "bridge". FIG. 7A is a cross-sectional view illustrating a crossbeam supported at only one end—a "cantilever". All materials, processes and dimensions may be the same as described hereinabove for a bridge construction, with the exception that there is only one hole 718*b*, (compare 118*b*) and one anchor 730*b* (compare 130*b*) at one end (right, as viewed) of the crossbeam 730 (compare 130). Note that the metal 750 (compare 150) may be slightly shorter than the crossbeam, to avoid the potential problems mentioned above which are avoided by making the metal a bit narrower than the crossbeam. Of course, the mechanical behavior of a cantilever is different than that of a bridge, but both will deflect when biased, as illustrated in FIG. 7B (for a bridge construction)

Operation of the Switch

In use, with the switch in its normally open (NO) (off-state) up-positions position, microwaves can propagate (or are propagating) along the waveguide (CPW). When a DC voltage, such as 20V is applied (via the bias pad 660), electrostatic forces cause the crossbeam to deflect, downward, until an under surface of the crossbeam (which is SiC) contacts the center conductor 106*b* and ground planes, which will closes the switch, which has the effect of shorting (short circuiting) the transmission line 106*b* to one or both of the ground planes 106*a* and 106*c*.

Figure 7B:
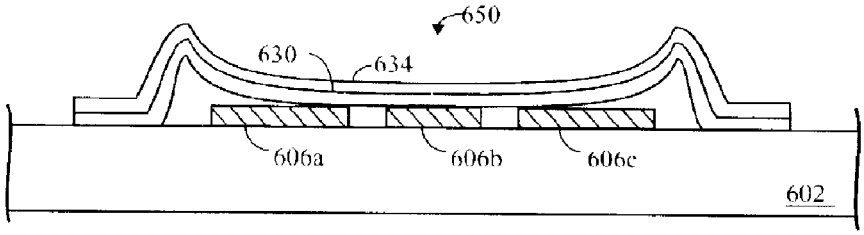
FIG. 7B is a cross-sectional view illustrating deflection of the crossbeam, according to the invention.

FIG. 7B (based on the FIG. 6 embodiment) is a cross-sectional view illustrating deflection of the crossbeam, according to the invention. Here it can be seen that when the switch "throws", the crossbeam 630 deflects downward (on-state) and at least touches the transmission line 606*b*, and preferably short circuits the transmission line to at least one, preferably both of the ground planes 606*a* and 606*c*. Since the crossbeam (SiC) is doped to be suitably conductive, this prevents propagation of the signal along the waveguide (CPW). This drawing is intended to be illustrative, rather than mechanically precise. And, the connection to the bias pad (660) is omitted, for illustrative clarity (was also omitted in the FIG. 1A-5D views).

While the invention has been described with respect to a limited number of embodiments, these should not be construed as limitations on the scope of the invention, but rather as exemplifications of some of the embodiments. Those skilled in the art may envision other possible variations, modifications, and implementations that are also within the scope of the invention, based on the disclosure set forth herein.

What is claimed is:

1. An RF MEMS switch comprising:

a crossbeam, which is an elongate member having two ends, comprising a non-metallic, electrically-conductive material, and extending transversely over and above a plurality of transmission lines; and means for biasing the crossbeam, causing an electrostatic force to deflect the cross beam to contact at least one of the transmission lines; and means for controlling the electrical conductivity of the crossbeam by ion implantation.

2. The RF MEMS switch of claim 1, wherein:

the non-metallic, electrically-conductive material comprises silicon carbide (SiC).

3. The RF MEMS switch of claim 1, wherein:

the transmission lines comprise a center conductor disposed between two ground planes, and form a coplanar waveguide (CPW).

4. An RF MEMS switch comprising:

a crossbeam, which is an elongate member having two ends, comprising a non-metallic, electrically-conductive material, and extending transversely over and above a plurality of transmission lines; and means for biasing the crossbeam, causing an electrostatic force to deflect the cross beam to contact at least one of the transmission lines; and the crossbeam has a thickness of approximately 80 microns.

5. The RF MEMS switch of claim 1, wherein the crossbeam further comprises:

at least one leg extending from at least one end of the crossbeam, to a surface of an underlying substrate, and supporting the crossbeam above the surface of the substrate, as well as above the plurality of transmission lines.

6. The RF MEMS switch of claim 5, wherein:

the at least one leg is formed integrally with the crossbeam.

7. The RF MEMS switch of claim 5, wherein:

the substrate comprises sapphire.

8. The RF MEMS switch of claim 4, wherein the means for biasing comprises:

at least one layer of metal disposed on a top surface of the crossbeam.

9. The RF MEMS switch of claim 8, wherein the at least one layer of metal comprises:

a layer of chromium (Cr) having a thickness of approximately 350 Å (Angstroms); and a layer of gold (Au) having a thickness of approximately 1500 Å (Angstroms).

10. The RF MEMS switch of claim 8, wherein:

the switch and transmission lines are disposed on a substrate; and the at least one layer of metal extends beyond the switch to a biasing pad on the substrate.

11. A method of forming an RF MEMS switch comprising:

depositing a crossbeam, which is an elongate member having two ends, comprising a non-metallic, electrically-conductive material, and extending transversely over and above a plurality of transmission lines;

controlling the electrical conductivity of the crossbeam by ion implantation; and controlling stress in the crossbeam by controlling the thickness of the crossbeam and by annealing the crossbeam.

12. The method of claim 11, wherein:

the non-metallic, electrically-conductive material comprises silicon carbide (SiC).

13. The method of claim 11, wherein:

the transmission lines comprise a center conductor disposed between two ground planes, and form a coplanar waveguide (CPW).

14. The method of claim 11, wherein:

the crossbeam has a thickness of approximately 80 microns.

15. The method of claim 1 further comprising:

providing at least one layer of metal disposed on a top surface of the crossbeam.

16. The method of claim 15, wherein the at least one layer of metal comprises:

a layer of chromium (Cr) having a thickness of approximately 350 Å (Angstroms); and a layer of gold (Au) having a thickness of approximately 1500 Å (Angstroms).

17. The method of claim 15, wherein the switch and transmission lines are disposed on a substrate, further comprising:

connecting the at least one layer of metal to a biasing pad on the substrate.

18. The RF MEMS switch of claim 1, further including means for controlling stress in the crossbeam by controlling the thickness of the crossbeam and by annealing the crossbeam.

19. An RF MEMS switch prepared by a process comprising the steps of:

depositing a crossbeam, which is an elongate member having two ends, comprising a non-metallic, electrically-conductive material, and extending transversely over and above a plurality of transmission lines; and controlling the electrical conductivity of the crossbeam by ion implantation.

20. The RF MEMS switch of claim 19 prepared by a process further including the step of:

controlling stress in the crossbeam by controlling the thickness of the crossbeam and by annealing the crossbeam.

* * * * *